US007959143B2

(12) United States Patent
Behmel et al.

(10) Patent No.: US 7,959,143 B2
(45) Date of Patent: Jun. 14, 2011

(54) FORMER ARRANGEMENT

(75) Inventors: Johannes Behmel, Plauen (DE); Andrea Schaedlich, Leubnitz (DE)

(73) Assignee: manroland AG, Offenbach/Main (DE)

( * ) Notice: Subject to any disclaimer, the term of this patent is extended or adjusted under 35 U.S.C. 154(b) by 349 days.

(21) Appl. No.: 12/239,388

(22) Filed: Sep. 26, 2008

(65) Prior Publication Data

US 2009/0090260 A1 Apr. 9, 2009

(30) Foreign Application Priority Data

Sep. 29, 2007 (DE) ..... 10 2007 046 811

(51) Int. Cl.
*B41F 13/58* (2006.01)

(52) U.S. Cl. ..... 270/5.01

(58) Field of Classification Search ..... 270/4–19, 270/5.01–5.03, 20.1, 52.07–52.1; 101/225
See application file for complete search history.

(56) References Cited

U.S. PATENT DOCUMENTS

| | | | | |
|---|---|---|---|---|
| 4,779,859 | A * | 10/1988 | Knauer | 270/41 |
| 5,016,863 | A * | 5/1991 | Birkmair | 270/41 |
| 6,364,821 | B1 * | 4/2002 | Mariotti et al. | 493/331 |
| 6,712,749 | B1 * | 3/2004 | Michalik et al. | 493/424 |

FOREIGN PATENT DOCUMENTS

| | | | |
|---|---|---|---|
| DE | 196 02 248 | A1 | 7/1997 |
| DE | 198 21 603 | A1 | 11/1999 |
| JP | 59209871 | A * | 11/1984 |

* cited by examiner

*Primary Examiner* — Leslie A Nicholson, III
(74) *Attorney, Agent, or Firm* — Crowell & Moring LLP

(57) ABSTRACT

A former arrangement for a rotary printing press is disclosed. The former arrangement includes a former arrangement module with a base element which is mountable on a stationary element of the rotary printing press. A former is connected to the base element. A first web lead device provides for guidance, on the former entry side, of a printing substrate web to be directed in the case of operation over the former. A second web lead device provides for guidance, on the former exit side, of the printing substrate web. The former rests on a cantilevered support element which is fastened with a first end to the base element and which extends cantilevered transverse to a web feed direction over the former.

11 Claims, 3 Drawing Sheets

FORMER ARRANGEMENT

This application claims the priority of German Patent Document No. 10 2007 046 811.5, filed Sep. 29, 2007, the disclosure of which is expressly incorporated by reference herein.

BACKGROUND AND SUMMARY OF THE INVENTION

The invention relates to a former arrangement.

A former arrangement of the type cited at the outset is known from German Patent Document No. DE 196 02 248 A1 for example. Another former arrangement is known from German Patent Document No. DE 198 21 603 A1 for example.

The former arrangements described in the above-mentioned documents for longitudinally folding printing substrate webs are each provided with a former, which is horizontally adjustable in a web feed direction or relative to a pair of ribbon lead-in rollers arranged underneath. However, these adjustable formers are arranged between two walls, as permanently arranged formers from the prior art normally are, so that operating the formers, for example when webbing up, must take place from their front side (on which the printing substrate web runs) or from their rear side.

As a result, an operator of conventional former arrangements is restricted in terms of his/her working movements, whereby make-ready procedures such as webbing up take a lot of time. Another disadvantage of these conventional former arrangements is that if, for example, several formers are arranged in a line successively, sufficient space must be provided between the formers so that an operator is still able to operate the formers and the associated adjusting elements.

The invention is based on the objective of creating a former arrangement that is easy to operate and that makes it possible to arrange several formers at a short distance (in the web feed direction) from each another.

According to the invention, a former arrangement for a rotary printing press is comprised of: a former arrangement module with a base element, which is mountable on a stationary element of the rotary printing press; a former, which is connected to the base element; first web lead means for guidance, on the former entry side, of a printing substrate web to be directed in the case of operation over the former; and second web lead means for guidance, on the former exit side, of the printing substrate web, wherein the former rests on a cantilevered support element, which is fastened with a first end to the base element and which extends in an otherwise unsupported manner cantilevered, transverse to a web feed direction over the former.

Due to the fact that the former rests on a cantilevered support element and not between two side frames as in the prior art, it is possible, in the case of the inventive former arrangement, for the former to be operated easily from the free or unsupported side. As a result, webbing-up beyond the former and into a subsequent folding unit is facilitated, for example.

Furthermore, the inventive attainment makes it possible to arrange two or more former arrangement modules at short distances in the web feed direction or horizontal direction since the formers may be operated easily from the free lateral side. In other words, the inventive former arrangement requires, particularly in the horizontal direction, less assembly and operating space than conventional former arrangements.

It must be mentioned in the context of the invention that the stationary element may be, for example, a separate side frame or, for example, a folding unit arrangement arranged beneath the former arrangement. The stationary element may be manufactured, for example, from steel, steel casting or aluminum or alloys thereof. Naturally, other embodiments and materials are possible for the stationary element as long as they guarantee stable support of the former arrangement.

Furthermore, it must be noted that the base element may be embodied, for example, in the form a solid side wall or, for example, in the form of a frame construction. The base element may be manufactured, for example, from steel, steel casting or aluminum or alloys thereof. Naturally, other embodiments and materials are possible for the base element as long as they guarantee stable support of the support element and of the former.

According to the invention, the support element may be embodied as an axle element for rotatable mounting of additional elements, as a profiled support or any other longish element. The base element may be manufactured, for example, from steel, aluminum or alloys thereof or any other material suitable for cantilevered support of the former.

According to a development of the invention, the former may have a first end and a second end, wherein the former may rest swivelably with its first end on the support element and may be connected on its second end to the base element, if necessary so that it is movable angularly.

With this embodiment of the invention, the former may, if its lower end is connected adjustably to the base element, be adjusted in a simple manner, for example, relative to the second web lead means in order to optimize the web feed or the longitudinal fold development.

According to another embodiment of the invention, a guide device may be provided on the base element, via which the base element is mountable position-changeably on the stationary element.

It is possible with this embodiment of the invention for the former arrangement or the associated former and the associated functional groups to be adapted, for example, to changed production conditions, which advantageously supports easy operation of the inventive former arrangement.

The guide device may, for example, be designed as a column guide, as a dovetail guide or as a profiled rail guide each with, for example, slide bearings or rolling bearings. Naturally, other suitable embodiments of the guide device are also possible.

According to another development of the invention, the guide device may have a first guide unit, which is arranged on a first end section of the base element, and a second guide unit, which is arranged on a second end section of the base element.

This embodiment of the invention advantageously supports a stable support and guidance of the base.

The guide units, for example, can be designed as a column guide, as a dovetail guide or as a profiled rail guide each with, for example, slide bearings or rolling bearings. Other suitable embodiments of the guide device are naturally also possible. Furthermore, according to the invention, both guide units may be embodied to be the same or different, for example.

According to a further embodiment of the invention, the base element may be horizontally movable by means of the guide device.

It is relatively simple with this embodiment of the invention to displace the former arrangement or the associated former and the associated functional groups in the web feed direction or horizontally, which is advantageous, for example, when changing the position of width-variable printing substrate web ribbons and a tape guide after the former.

According to another development of the invention, the first web lead means may have a former lead-in roller, which is pivoted on the support element.

With this embodiment of the invention, because the first end of the former may rest swivelably on the support element that is embodied in this case as an axle element and at the same time a former lead-in roller may be pivoted on the support element, it may be guaranteed in an advantageous manner that, when swiveling the former, the predetermined optimal arrangement relationship of the former and former lead-in roller remains unchanged so that a printing substrate web to be guided over the former is always optimally guided to the former.

According to another embodiment of the invention, the first web lead means may have a nipping/collecting roller, which is pivoted on a supporting element provided on the first end section of the base element.

This embodiment of the invention is particularly advantageous if several layers of printing substrate webs are to be guided to the former in order to, if necessary, compensate for different web speeds of the layers.

According to another development of the invention, driving means may be provided for rotationally driving the former lead-in roller and the nipping/collecting roller.

Among other things, this embodiment of the invention supports in an advantageous manner, the above-mentioned compensation of, if necessary, different web speeds of the layers if several layers of printing substrate webs are to be guided to the former.

The driving means may comprise a motor, for example, such as an electric motor, an air motor or a hydraulic motor, wherein the motor is connected via suitable transmission means, such as a V-belt, a timing belt, a flat belt, a drive chain, etc., and corresponding pulleys or rings gears, to the former lead-in roller and the nipping/collecting roller. Naturally, other embodiments of the driving means are also possible as long they are able to realize a rotational driving of the former lead-in roller and the nipping/collecting roller.

According to another embodiment of the invention, the driving means may have a motor, which is mounted on the base element.

Among other things, this embodiment supports a compact design of the former arrangement and a simple adjusting or moving of the same in an advantageous manner.

According to another development of the invention, a cantilevered support arm may be provided on the second end section of the base element, on which support arm the second web lead means rest.

This embodiment of the invention also advantageously supports a compact design of the former arrangement and a simple adjusting or moving of the same as a unit. Because of the cantilevered mounting of the second web lead means, which, for example, may comprise a pair of ribbon lead-in rollers, easy operation of the same is possible from the free lateral side, thereby supporting a horizontal arrangement of several former arrangement modules at short distances.

According to another development of the invention, the first guide unit and the second guide unit may each have a guide column for accommodating and guiding the base element.

This embodiment of the invention is particularly advantageous because of its stability and guidance precision and its cost-effective manufacturability.

According to the invention, for example, rolling bearings or slide bearings may cooperate with the guide columns, which may be manufactured from a suitable steel material, making a simple and precise guidance movement of the former arrangement module possible.

According to another development of the invention, at least a second former arrangement module may be provided, which is accommodated and guided on the guide columns of the other former arrangement module.

With this embodiment of the invention it is advantageously possible to longitudinally fold two printing substrate web ribbons, each of which may have one or more layers of printing substrate webs, over respectively one of the two former arrangement modules of the former arrangement, wherein the former arrangement modules may be moved or adjusted in accordance with the production conditions, such as the ribbon width for example.

Naturally, it is also possible according to the invention to integrate more than two former arrangement modules into the former arrangement.

In summary, the advantages of the inventive former arrangement are that, among other things, the following are guaranteed: an improved operability of the former during webbing up, a relatively simple adjustment of the former and the associated functional groups in the direction of the web, which is advantageous when changing the position of width-variable ribbons and a tape guide after the former, and the possibility of arranging two or even more formers at short distances in the direction of the web, wherein the formers with their associated functional groups are individually operable and adjustable in the direction of the web The above-mentioned advantages are produced from a cantilevered suspension of the former and the associated functional groups on the base element, which is embodied, for example, as a side wall. The former arrangement module may be attached in a stationary manner or be adjusted as a unit via, for example, guide rails in the direction of the web.

In the following, the invention will be described in more detail on the basis of preferred embodiments and making reference to the enclosed figures.

DETAILED DESCRIPTION OF THE DRAWINGS

Figure 1:
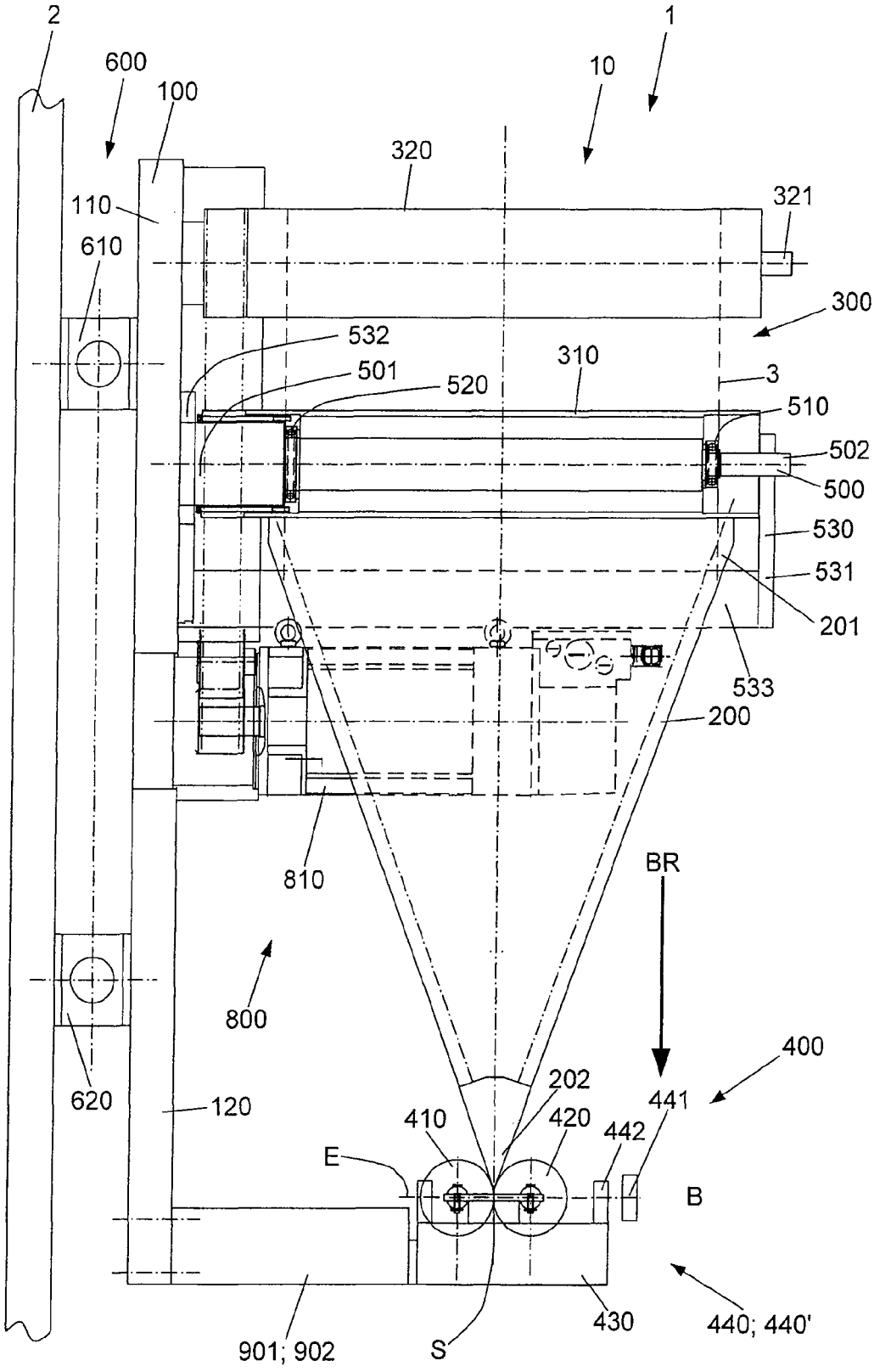
FIG. 1 shows a schematic front view of a first embodiment of the inventive former arrangement.

FIG. 1 shows a schematic front view of a former arrangement 1 for a web-fed rotary printing press (not shown and hereafter designated only as printing press) according to a first embodiment of the invention. The former arrangement 1 features a former arrangement module 10, which features a base element in the form of a side wall 100, a former 200, which is connected to the side wall 100, a first web lead device 300 for guidance, on the former entry side, of a printing substrate web 3 to be directed in the case of operation over the former 200, a second web lead device 400 for guidance, on the former exit side, of the printing substrate web 3, and a cantilevered support element in the form of an axle element 500, on which the former 200 rests and which is fastened with a first end 501 to the side wall 100 and which extends in an otherwise unsupported manner cantilevered, transverse to a web feed direction BR over the former 200.

In other words, the axle element 500 is fastened by means of, for example, screws on one side on the side wall 100 so that it extends in a cantilevered manner from the side wall 100.

Provided on the side wall 100 is a guide device in the form of a column guide 600, via which the side wall 100 is mounted position-changeably on a stationary element (that is part of the printing press) in the form of a side frame 2 of a folding unit arrangement (not shown) arranged under the former arrangement 1.

The column guide 600 has a first guide unit 610, which is arranged on a first end section 110 of the side wall 100, and a second guide unit 620, which is arranged on a second end section 120 of the side wall 100.

Figure 2:
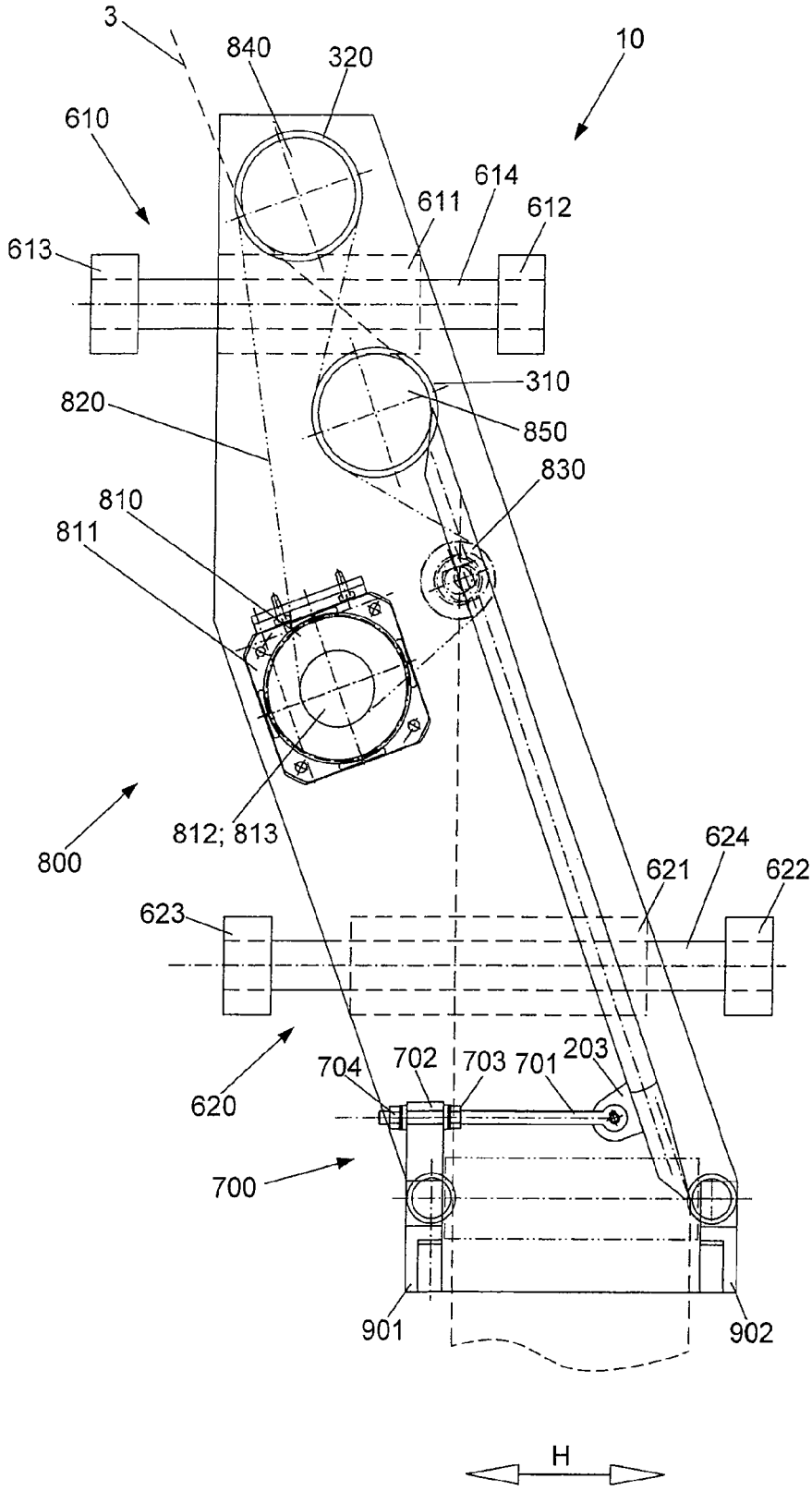
FIG. 2 shows a schematic side view of the first embodiment of the inventive former arrangement.

Again making reference to FIG. 2, which shows a schematic side view of the former arrangement 1 according to the first embodiment of the invention, the first guide unit 610 has a first bearing block 611, a second and a third bearing block 612 and 613 as well as a guide column 614.

The first bearing block 611 is attached to the side wall 100 and has a through bore-hole running in the horizontal direction H. The second and the third bearing blocks 612, 613 are attached at a horizontal distance from one another on the side frame 2 and each have a through bore-hole running in the horizontal direction H. The guide column 614 extends through the through bore-hole of the first bearing block 611 and is inserted firmly with its two longitudinal ends into the through bore-hole of respectively one of the second and the third bearing blocks 612, 613.

An inside diameter of the through bore-hole of the first bearing block 611 and an outside diameter of the guide column 614 are dimensioned in such a way that the first bearing block 611 (and thus the side wall 100) is displaceable, sliding without play, in the horizontal direction H on the guide column 614. For this purpose, the guide column 614 and the first bearing block 611 are set up so that they form a slide bearing.

The second guide unit 620 has a first bearing block 621, a second and a third bearing block 622 and 623 as well as a guide column 624.

The first bearing block 621 is attached to the side wall 100 and has a through bore-hole running in the horizontal direction H. The second and third bearing blocks 622, 623 are attached at a horizontal distance from one another on the side frame 2 and each have a through bore-hole running in the horizontal direction H. The guide column 624 extends through the through bore-hole of the first bearing block 621 and is firmly inserted with its two longitudinal ends into the through bore-hole of respectively one of the second and the third bearing blocks 622, 623.

An inside diameter of the through bore-hole of the first bearing block 621 and an outside diameter of the guide column 624 are dimensioned in such a way that the first bearing block 621 (and thus the side wall 100) is displaceable, sliding without play, in the horizontal direction H on the guide column 624. For this purpose, the guide column 624 and the first bearing block 621 are set up so that they form a slide bearing.

Because of the inventive embodiment of the first and the second guide unit 610 and 620, the side wall 100 is horizontally movable on the side frame 2.

Making reference to FIG. 1 and FIG. 2 again, the former 200 has a first end 201 and a second end 202, wherein the first end 201 rests swivelably on the axle element 500 via a support 530 and the second end 202 is connected to the side wall 100 in a swivelably adjustable manner via an adjusting device 700 and a support arm 901 attached in a cantilevered manner on the side wall 100. Reference will be made later to this support arm.

In other words, the support 530 is a U-shaped element, whose legs 531 and 532 are attached swivelably to the first end 501 or the second end 502 of the axle element 500 via bearings that are depicted only schematically as through bore-holes. The crosspiece 533 of the U-shaped support 530 that connects the legs 531, 532 is embodied in a plate-like manner and extends beneath the axle element 500 and parallel to it. The first end 201 of the former 200 rests on the crosspiece 533 and is fastened thereon.

The adjusting device 700 has a threaded spindle 701, a bearing block 702, which is attached to the support arm 901, and adjusting nuts 703, 704. A longitudinal end of the threaded spindle 701 is coupled with a plate 203 projecting on the rear side from the second end 202 of the former, wherein a locking pin (not labeled) is inserted and secured in a through hole in the plate 203. The other longitudinal end of the threaded spindle 701 is inserted into a through bore-hole embodied in the bearing block 702, wherein the adjusting nuts 703, 704 are screwed onto a thread embodied on the adjusting spindle 701 in the region of the through bore-hole in such a way that the adjusting nuts 703, 704 abut side surfaces of the bearing block 702 on both ends of the through bore-hole.

Changing the axial position of the adjusting nuts 703, 704 by rotationally manipulating them makes it possible for the adjusting spindle 701 to be displaced axially in the through bore-hole of the bearing block 702, whereby the former 200 may be swiveled around the axle element 500.

As shown in FIG. 1 in particular, the first web lead device 300 features a former lead-in roller 310, which is pivoted on the axle element 500 via bearings 510, 520, such as radial ball bearings or radial roller bearings, and according to this embodiment of the invention is embodied as a nipping roller, and a nipping/collecting roller 320, which is pivoted on a supporting element 321, which is attached in a cantilevered manner on the first end section 110 of the side wall 100 and which is also embodied as an axle, via bearings, radial ball bearings or radial roller bearings (not shown).

It must be mentioned in this connection that, because the first end 201 of the former 200 rests swivelably on the axle element 500 and at the same time the former lead-in roller 310 is pivoted on the axle element 500, it may be guaranteed in an advantageous manner that, when swiveling the former 200, a predetermined optimal arrangement relationship of the former 200 and the former lead-in roller 310 remains unchanged so that a printing substrate web 3 to be guided over the former 200 is always optimally guided to the former 200.

As maybe seen in FIG. 2 in particular, the driving device 800 is set up in such a way that it is possible to rotationally drive the former lead-in roller 310 and the nipping/collecting roller 320 with it. Expressed more precisely, the driving device 800 has an electrical motor 810, a timing belt 820, a guide/drag roller 830 and two drive wheels 840 and 850.

The electric motor 810 is mounted via a flange 811 provided thereon and fastening screws (not labeled) on the side wall 100 below the support 530. A drive pinion 813 for the timing belt 820 is provided on the end of a drive shaft 812 of the electric motor 810 that projects towards the side wall 100. A drive wheel 840 is attached in a rotationally secured manner to the longitudinal end of the nipping/collecting roller 320 that points towards the side wall 100 and the other drive wheel 850 is attached in a rotationally secured manner to the longitudinal end of the former lead-in roller 310 that points to the side wall 100. The guide/drag roller 830 is rotatably and adjustably attached to the side wall 100 via fastening means (not labeled). The timing belt 820 winds around the drive pinion 813, the drive wheels 840 and 850 as well as the guide/drag roller 830 so that rotary propulsion is made available for the former lead-in roller 310 and the nipping/collecting roller 320 when operating the electric motor.

The former lead-in roller 310 and the nipping/collecting roller 320 are rotationally driven in opposite directions during operation so that the printing substrate web 3, as shown in FIG. 2, may be conveyed to former 200. More precisely, when being introduced into the former arrangement 1, the printing substrate web 3 first makes contact with its one side (in FIG. 1 the front side) with the nipping/collecting roller 320 and afterwards with its other side (in FIG. 1 the rear side and the side with which it later also rests on the former 200) with the former lead-in roller 310.

As shown in FIG. 1 and FIG. 2, two support arms 901 and 902 are fastened on one side to the second end section 120 of the side wall 100 by means of, for example, screws so that they extend from the side wall 100 in a cantilevered manner, wherein the second web lead device 400 is supported on the support arms 901, 902 and fastened by means of fastening agents (not shown) such as, for example, screws.

The second web lead device 400 features a pair of ribbon lead-in rollers 410 and 420, which are pivoted and adjustable in a plane E (see FIG. 1) on a base body 430 fastened on the support arms 901, 902, and two adjusting units 440, 440' for adjusting the ribbon lead-in rollers 410, 420 in plane E.

As FIG. 1 and FIG. 2 show, one of the adjusting units 440 and 440' is respectively provided on the respective adjacent longitudinal ends of the pair of ribbon lead-in rollers 410, 420. In other words, a first adjusting unit 440 is arranged on the rear (concealed in FIG. 1) longitudinal ends of ribbon lead-in rollers 410, 420 and a second adjusting unit 440' is arranged on the front (in FIG. 1) longitudinal ends of ribbon lead-in rollers 410, 420, wherein the first and the second adjusting units 440, 440' are embodied to be identically except for differences related to the arrangement side.

The adjusting units 440, 440' each feature a first drive device (not labeled), which has a first rotary knob 441 and which is connected to a longitudinal end of a rotational axis of the one ribbon lead-in roller 410 so that the longitudinal end of the rotational axis of this ribbon lead-in roller 410 is displaceable in a controlled manner in the plane E (see FIG. 1).

Furthermore, the adjusting units 440, 440' each feature a second drive device (not labeled), which has a second rotary knob 442 and which is connected to a longitudinal end of a rotational axis of the other ribbon lead-in roller 420 so that the longitudinal end of the rotational axis of this ribbon lead-in roller 420 is displaceable in a controlled manner in the plane E (see FIG. 1).

In other words, the two ribbon lead-in rollers 410, 420 may be moved apart or together in the plane E by means of the two adjusting units 440, 440' such that a gap S is increased or reduced between the two ribbon lead-in rollers 410, 420 in terms of its width (in FIG. 1 the right-left direction). It must be mentioned in this connection that depending upon requirements, the two ribbon lead-in rollers 410, 420 may be moved symmetrically or asymmetrically as well as parallel or at an angle to one another with respect to a former center formed by the former leader (depicted in FIG. 1 as dash-dot center line of the former 200).

The arrangement of the rotary knobs 441, 442 of the respective adjusting unit 440, 440', which show rotary knobs 441, 442 both in the direction of an operating side B, permits an adjustment of the ribbon lead-in rollers 410, 420 in the plane E from the operating side B.

In summary, FIG. 1 shows a frontal view of the former 200. Mounted firmly on the side wall 100 on one side is the axle element 500, on which the former 200 is positioned on the bearing contact points or bearings 510, 520 as well as the former lead-in roller 310 in the depicted example. The ribbon lead-in rollers 410, 420 sit on support arms 901, 902 that have been attached in a cantilevered manner. The adjustment of the ribbon lead-in rollers 410, 420 is accomplished by means of operating elements or the rotary knobs 441, 442, which point towards the open side B. In the depicted example, the former lead-in roller 310 is embodied as a nipping roller. The former lead-in roller 310 and the upstream nipping/collecting roller 320 are driven by an electric motor 810 and in this case by means of a timing belt 820. The functional elements attached to the side wall 100 are positioned as a unit on guide elements or guide columns 614, 624 and therefore are adjustable in the direction of the web or the horizontal direction H.

FIG. 2 shows the former arrangement module 10 according to the first embodiment of the invention in cross-section, wherein, in addition to the elements shown in FIG. 1, the mounting and adjustment possibility of the former 200 on the former leader are evident.

According to other embodiments that are not depicted and described in detail here, equipping with other functional elements as well as a permanently attached, non-adjustable arrangement of the former 200 is also possible.

Figure 3:
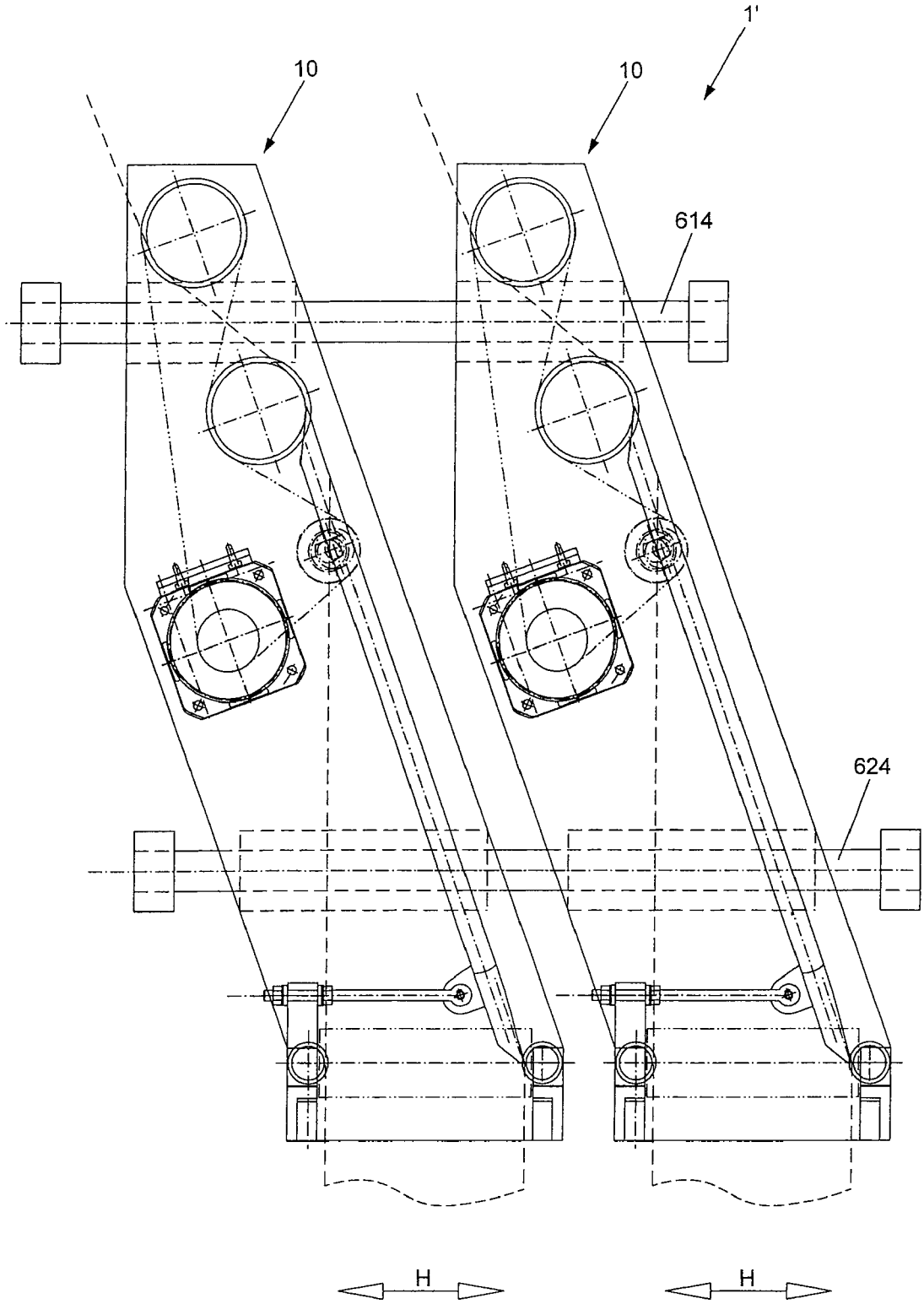
FIG. 3 shows a schematic side view of a second embodiment of the inventive former arrangement.

Reference is now made to FIG. 3, which shows a schematic side view of a former arrangement 1' according to a second embodiment of the invention.

As FIG. 3 shows, the former arrangement 1' in accordance with the second embodiment has two former arrangement modules 10. The former arrangement modules 10 according to the second embodiment of the invention are embodied in an identical manner to the former arrangement module 10 that was described in reference to the first embodiment of the invention (FIGS. 1 and 2).

As is further shown in FIG. 3, the two former arrangement modules 10 are, however, accommodated jointly on a single pair of guide columns 614 and 624. In other words, according to the second embodiment of the invention, a second former arrangement module 10 is provided, which is accommodated and guided on the guide columns 614, 624 of the other former arrangement module 10. For this purpose, the guide columns 614, 624 according to the second embodiment of the invention are embodied to be longer than those according to the first embodiment of the invention.

The two former arrangement modules 10 are arranged in FIG. 3 at short distances from one another. This allows one to see that, in the case of an arrangement of the two former arrangement modules 10 in this manner, operation (such as, for example, webbing up and adjusting the ribbon lead-in rollers 410, 420) may take place advantageously from a single side (the operating side B) of the former arrangement modules 10, which is guaranteed by the cantilevered attachment of the respective former 200 on the respective associated side wall 100.

As indicated by the respective double arrow in FIG. 3, the respective side walls 100 are horizontally movable (in the horizontal direction H) on the side frame 2 so that, if required, a horizontal adjustment of the two former arrangement modules 10 for example with respect to a downstream folding unit arrangement (not shown) may be carried out.

According to further embodiments of the invention that are not depicted here, more than two formers 200 or former arrangement modules 10 may naturally also be arranged in succession.

LIST OF REFERENCE NUMBERS

1 Former arrangement (first embodiment)
1' Former arrangement (second embodiment)

2 Stationary element or side frame
3 Printing substrate web
10 Former arrangement module
100 Base element or side wall
110 First end section (of the side wall)
120 Second end section (of the side wall)
200 Former
201 First end (of the former)
202 Second end (of the former)
203 Plate
300 First web lead device
310 Former lead-in roller
320 Nipping/collecting roller
321 Supporting element (axle)
400 Second web lead device
410 Ribbon lead-in roller
420 Ribbon lead-in roller
430 Base body
440 Adjusting unit
440' Adjusting unit
441 First rotary knob
442 Second rotary knob
500 Support element or axle element
501 First end (of the axle element)
502 Second end (of the axle element)
510 Bearing
520 Bearing
530 Support
531 Leg (of the support)
532 Leg (of the support)
533 Crosspiece (of the support)
600 Guide device or column guide
610 First guide unit
611 First bearing block
612 Second bearing block
613 Third bearing block
614 Guide column
620 Second guide unit
621 First bearing block
622 Second bearing block
623 Third bearing block
624 Guide column
700 Adjusting device
701 Threaded spindle
702 Bearing block
703 Adjusting nut
704 Adjusting nut
800 Driving device
810 Motor
811 Flange
812 Drive shaft
813 Drive pinion
820 Timing belt
830 Guide/drag roller
840 Drive wheel
850 Drive wheel
901 Support arm
902 Support arm
B Operating side
BR Web feed direction over the former
E Adjusting plane
H Horizontal direction or adjustment direction
S Gap The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A former arrangement for a rotary printing press, comprising:

a former arrangement module including:

a base element which is mountable on a stationary element of the rotary printing press, a former which is connected to the base element, a first web lead device for guidance, on a former entry side, of a printing substrate web to be directed over the former, a second web lead device for guidance, on a former exit side, of the printing substrate web, and a cantilevered support element, wherein the former rests on the cantilevered support element and wherein the cantilevered support element is fastened with a first end to the base element and extends cantilevered transverse to a web feed direction over the former, wherein the first web lead device includes a former lead-in roller which is pivoted on the cantilevered support element.

2. The former arrangement according to claim 1, wherein the former has a first end and a second end and wherein the former rests swivelably with the first end on the support element and is connected on the second end to the base element.

3. The former arrangement according to claim 1, wherein a guide device is provided on the base element via which the base element is mountable position-changeably on the stationary element.

4. The former arrangement according to claim 3, wherein the base element is horizontally movable by the guide device.

5. The former arrangement according to claim 3, wherein the guide device has a first guide unit which is arranged on a first end section of the base element and a second guide unit which is arranged on a second end section of the base element.

6. The former arrangement according to claim 5, further comprising a cantilevered support arm provided on the second end section of the base element, wherein the second web lead device rests on the support arm.

7. The former arrangement according to claim 5, wherein the first guide unit and the second guide unit each have a guide column for accommodating and guiding the base element.

8. The former arrangement according to claim 7, further comprising a second former arrangement module, wherein the second former arrangement module is accommodated and guided on the guide columns of the first guide unit and the second guide unit.

9. The former arrangement according to claim 1, wherein the first web lead device includes a nipping/collecting roller which is pivoted on a supporting element provided on a first end section of the base element.

10. The former arrangement according to claim 9, further comprising a driving device which rotationally drives the former lead-in roller and the nipping/collecting roller.

11. The former arrangement according to claim 10, wherein the driving device includes a motor which is mounted on the base element.

* * * * *